US007497560B2

(12) United States Patent
Endo

(10) Patent No.: US 7,497,560 B2
(45) Date of Patent: Mar. 3, 2009

(54) LIQUID EJECTING APPARATUS

(75) Inventor: Tsunenobu Endo, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 367 days.

(21) Appl. No.: 11/357,490

(22) Filed: Feb. 17, 2006

(65) Prior Publication Data

US 2006/0187264 A1 Aug. 24, 2006

(30) Foreign Application Priority Data

Feb. 18, 2005 (JP) ..... 2005-043197

(51) Int. Cl.
*B41J 2/085* (2006.01)
*B41J 2/165* (2006.01)

(52) U.S. Cl. ..... 347/76; 347/36

(58) Field of Classification Search ..... 347/36, 347/76, 55, 68, 73
See application file for complete search history.

(56) References Cited

U.S. PATENT DOCUMENTS 6,168,259 B1 1/2001 Capurso
6,802,591 B2 * 10/2004 Takahashi ..... 347/36

FOREIGN PATENT DOCUMENTS

JP 2004-202867 7/2004

* cited by examiner

*Primary Examiner*—Stephen D Meier
*Assistant Examiner*—Geoffrey Mruk
(74) *Attorney, Agent, or Firm*—Edwards Angell Palmer & Dodge LLP; John J. Penny, Jr.

(57) ABSTRACT

Aerosols are applied to an absorbing member by forming a stable and uniform electric field between a nozzle plate and the absorbing member. A liquid ejecting apparatus includes: a liquid ejecting head that has a conductive nozzle plate and discharges liquid from openings of the nozzle plate during reciprocating above recording material; a recording material side electrode that is arranged farther than the recording material opposite the nozzle plate in a direction in which the liquid is discharged; a potential difference generating means that generates a potential difference between the nozzle plate and the recording material side electrode to electrically attract the liquid discharged from the openings of the nozzle plate toward the recording material side electrode; and a nozzle plate side electrode that is arranged in a direction of reciprocation of the nozzle plate and has a potential difference of the same direction as that of the potential difference between the nozzle plate and the recording material side electrode.

9 Claims, 11 Drawing Sheets

LIQUID EJECTING APPARATUS

CROSS REFERENCE TO THE RELATED APPLICATION

This patent application claims priority from a Japanese Patent Application No. 2005-043197 filed on Feb. 18, 2005, the contents of which are incorporated herein by reference.

BACKGROUND OF THE INVENTION

1. Field of the Invention

The present invention relates to a liquid ejecting apparatus. More particularly, the present invention relates to a liquid ejecting apparatus that applies liquid discharged from openings of a nozzle plate mounted on a liquid ejecting head to recording material, 2. Description of Related Art When a liquid ejecting apparatus applies liquid to recording material without leaving a blank space on a peripheral border of the recording material, the liquid ejecting apparatus anticipates displacement between the recording material and a liquid ejecting head so that the liquid is ejected over a region slightly wider than the dimension of the recording material. For this reason, the liquid is discharged to an area, on which the recording material is not located, in the neighborhood of both side edges and upper and lower ends of the recording material. Thus, in order to prevent surplus liquid from flying in all directions and contaminating the periphery, an absorbing member is arranged at a position facing the liquid ejecting head in the direction in which the liquid is discharged to cause the absorbing member to absorb the surplus liquid not applied to the recording material.

In addition, recording material may extend and crease by applying liquid over the material. At this time, when the extended recording material contacts with the absorbing member by bending the material due to wrinkles, the recording material is applied to the liquid, which has already been absorbed in the absorbing member, to be contaminated. Thus, in anticipation of the extension of the recording material, a gap of around 2 to 4 mm is provided between the recording material and the absorbing members in the liquid ejecting apparatus. In addition, an interval of around 1 mm is provided between a nozzle plate and the recording material.

On the other hand, upon request of resolution improvement of a recording image, a current liquid ejecting apparatus miniaturizes droplets discharged from the openings of the nozzle plate up to about a few pl. Since such a minute droplet has extremely small mass, a droplet, which has once been discharged, rapidly loses kinetic energy due to viscous resistance of an atmosphere. Specifically, the velocity of a droplet less than, e.g., 8 pl reaches generally zero after the droplet flies around 3 mm in the atmosphere. A minute droplet losing kinetic energy takes a balance between falling motion by acceleration of gravity and viscous resistance force of an atmosphere, and thus requires long time up to termination of falling.

In addition, in the case of a distance of 3 to 5 mm obtained by adding the gap between the nozzle plate and the recording material to the interval between the recording material and the absorbing member, the discharge velocity of the liquid ejecting apparatus for a droplet of 3 pl is set highly in order to transfer the droplet from the nozzle plate to a surface of the absorbing member. However, viscous resistance of the atmosphere acting on the droplet further increases to reduce travel distance on the contrary. Moreover, when the discharge velocity is high, an extremely minute droplet referred to as satellite ink generated when the droplet leaves the nozzle plate is easy to be generated.

Furthermore, the liquid ejecting apparatus periodically repeats an operation referred to as flushing. The flushing is an operation of sending a driving signal to a liquid ejecting head in a state that recording material is not in the apparatus, so to speak, to attack liquid. By such an operation, liquid having increased viscosity is removed from a nozzle with a little discharge volume. However, since liquid discharged by this flushing is consumed for only flushing, a small droplet is discharged to save consumption of liquid. Moreover, since time required for flushing reduces throughput of an original recording operation, liquid is discharged from all nozzles in the shortest time in the flushing. In such a flushing operation, a large quantity of satellite ink is generated.

Most of satellite ink generated as a result of various events as described above becomes aerosol floating in the vicinity of a traveling area of the liquid ejecting head. A part of the aerosol floats to the outside of the liquid ejecting apparatus and is applied to the perimeter of the liquid ejecting apparatus. Moreover, most of aerosol is applied to each portion in the liquid ejecting apparatus before long. Especially, when aerosol is applied on a carrying path of recording material such as a platen, recording material to be next carried is contaminated. Furthermore, when aerosol is applied to an electric circuit, a linear scale, various optical sensors, and so on of the liquid ejecting apparatus, malfunction of the apparatus may be caused. Moreover, when a user touches a part on which aerosol is applied, a hand of the user is also contaminated.

Japanese Patent Application Publication No. 2004-202867 discloses a liquid ejecting apparatus including a function of collecting the aerosol actively.

A liquid ejecting apparatus disclosed in this patent document includes an absorbing member that is arranged at a position facing a nozzle plate in order to absorb surplus liquid that is not applied to recording material. Moreover, one electrode is a metallic component arranged on a surface of the absorbing member, and the other electrode is a nozzle plate made of metal and formed with openings for discharging liquid droplets. When voltages different from each other are applied to these electrode and nozzle plate, an electric field is formed between them. Moreover, droplets discharged from a nozzle plate in such a liquid ejecting-apparatus are charged with electricity to be the same electrode as that of the nozzle plate due to so-called lightning conductor effect at the instant of being discharged from the nozzle plate. For this reason, since droplets floating as aerosols are charged with electricity, the droplets head for an electrode without being decelerated by coulomb force acting between the droplet and an electric field, and are adsorbed and applied to the electrode having the polarity opposite to that of the droplets. The droplets applied to the electrode are absorbed by a capillary phenomenon, and are finally absorbed in the absorbing member.

As described above, there is proposed a technique forming an electric field by means of electrification of aerosols and collecting the aerosols actively. However, since some of aerosols are charged with electricity having the polarity opposite to that of the nozzle plate, some aerosols cannot be guided toward the absorbing member in a configuration disclosed in the patent document.

SUMMARY OF THE INVENTION

Therefore, it is an object of the present invention to provide a liquid ejecting apparatus that can solve the foregoing problems. The above and other objects can be achieved by combinations described in the independent claims. The dependent claims define further advantageous and exemplary combinations of the present invention.

According to the first aspect of the present invention, there is provided a liquid ejecting apparatus. The liquid ejecting apparatus includes: a liquid ejecting head that has a conductive nozzle plate and discharges liquid droplets from openings of the nozzle plate while reciprocating above recording material; a recording material side electrode that is arranged farther than the recording material opposite the nozzle plate in a direction in which the liquid is discharged; a potential difference generating means that generates a potential difference between the nozzle plate and the recording material side electrode to electrically attract the liquid discharged from the openings of the nozzle plate toward the recording material side electrode; and a nozzle plate side electrode that is arranged in a direction of reciprocation of the nozzle plate and has a potential difference of the same direction as that of the potential difference between the nozzle plate and the recording material side electrode. In this way, it is possible to apply liquid charged with electricity in a direction of the same potential as that of the recording material side electrode to the nozzle plate side electrode.

In the liquid ejecting apparatus, the nozzle plate side electrode may surround a periphery of the nozzle plate in a surface direction of the nozzle plate. In this way, it is possible to more apply liquid charged with electricity in a direction of the same potential as that of the recording material side electrode to the nozzle plate side electrode.

In the liquid ejecting apparatus, the nozzle plate side electrode may be arranged on the same face as that of the nozzle plate or a face receded from the nozzle plate in the direction in which the liquid is discharged. In this way, when the nozzle plate is wiped with a wiper, the entire surface on the nozzle plate can be wiped without interference of the nozzle plate side electrode. Moreover, in reciprocation of the liquid ejecting head, it is possible to prevent the nozzle plate side electrode from getting in contact with the recording material.

In the liquid ejecting apparatus, the nozzle plate side electrode may have a pair of electrode pieces arranged to be electrically detached from each other in the direction of reciprocation while holding the nozzle plate therebetween, and the liquid ejecting apparatus may further include a switching means that electrically connects the potential difference generating means to one electrode piece located on a side pursuing a movement of the nozzle plate in the direction of reciprocation of the nozzle plate and electrically disconnects the potential difference generating means from the other electrode piece, among the pair of electrode pieces. In this way, it is possible to selectively activate only the electrode pursuing a movement of the nozzle plate to efficiently collect aerosols.

The summary of the invention does not necessarily describe all necessary features of the present invention. The present invention may also be a sub-combination of the features described above.

BRIEF DESCRIPTION OF THE DRAWINGS

The above and other objects and features and advantages of the present invention will become more apparent from the following description of the presently preferred exemplary embodiments of the invention taken in conjunction with the accompanying drawings, in which.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
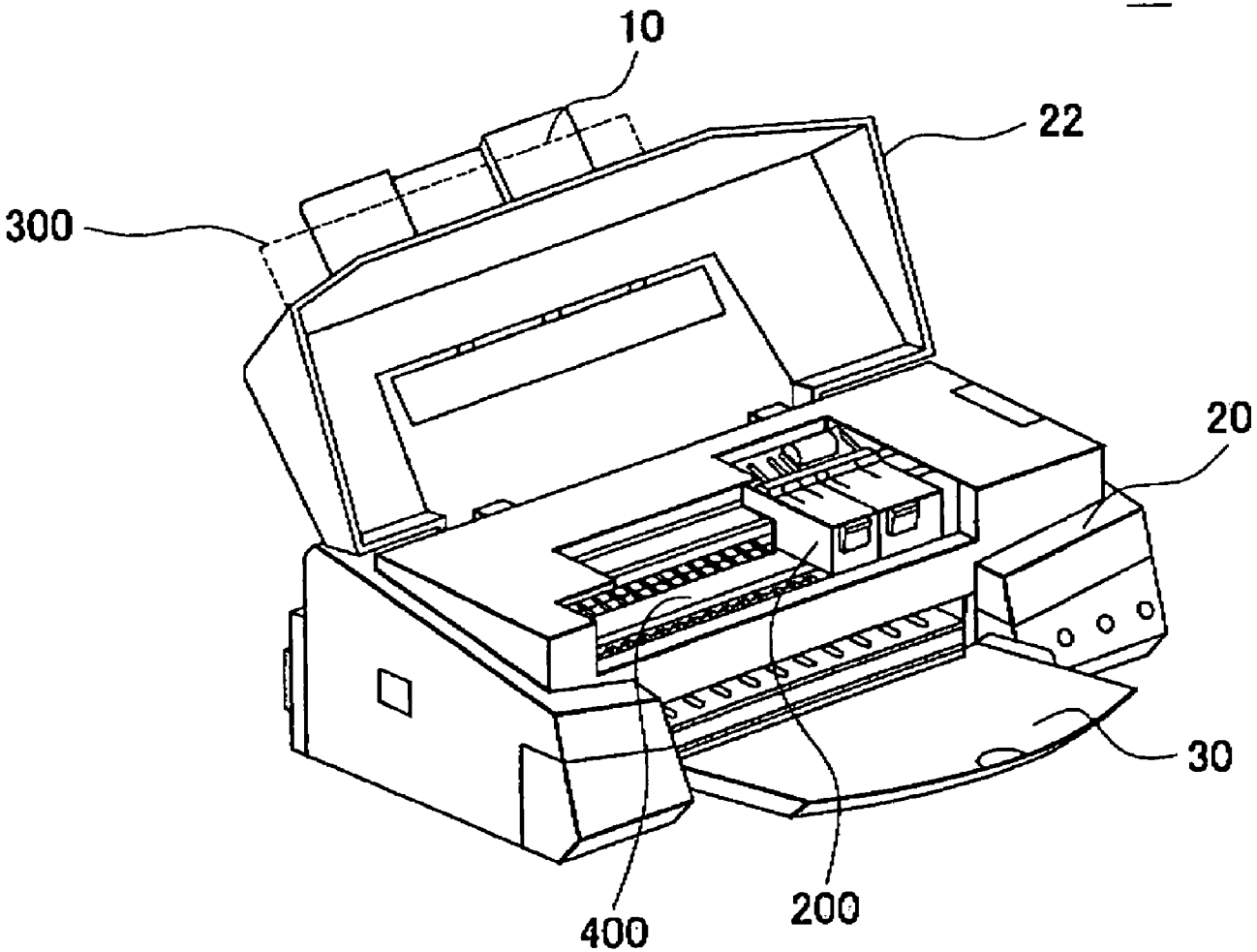
FIG. 1 is a perspective view showing the whole of an ink-jet type recording apparatus.

FIG. 1 is a perspective view surveying an ink-jet type recording apparatus 11 that is an embodiment of the present invention, and shows a state that a top case 22 as a cover is opened. As shown in FIG. 1, the ink-jet type recording apparatus 11 includes a bottom case 20 that is a base of the apparatus, a top case 22 that forms a casing with the bottom case 20, a hopper 10 that is mounted to a rear portion of the bottom case 20, and a discharge tray 30 that is formed on a front face of the bottom case 20. Moreover, the ink-jet type recording apparatus 11 includes a platen 400 that is horizontally arranged in the bottom case 20 and a carriage 200 that is arranged on the upper side of the platen 400, on the inner side of the casing.

In the ink-jet type recording apparatus 11 as described above, recording material 300 accommodated on the hopper 10 is sent onto the platen 400 one piece by one piece by means of a carrying-in section not shown, and is further sent to a discharge tray 30 by means of a discharging section not shown. Moreover, in the ink-jet type recording apparatus 11, the carriage 200 reciprocates in the direction perpendicular to a transportation direction of the recording material 300 on the upper side of the platen 400. Therefore, since the transportation of the recording material 300 and the reciprocation of the carriage 200 are performed alternately, the whole top face of the recording material 300 can be scanned by the carriage 200 and thus a record operation can be performed on an arbitrary area on a surface of the recording material 300.

Figure 2:
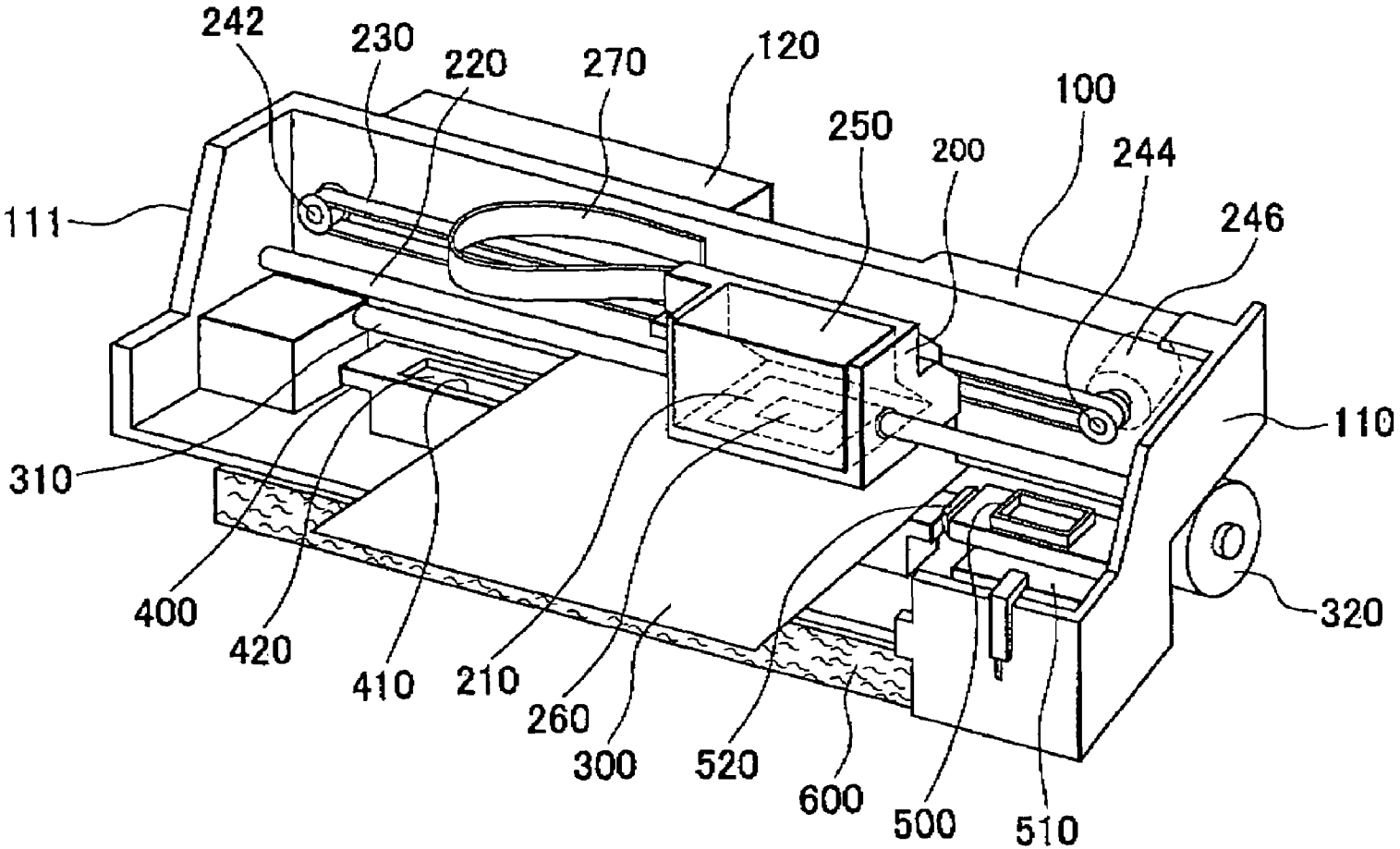
FIG. 2 is a perspective view showing an internal mechanism of an ink-jet type recording apparatus.

FIG. 2 is a perspective view showing an internal mechanism 12 of the ink-jet type recording apparatus 11 shown in FIG. 1 by pulling out a frame 100 and side face portions 110 and 111. As shown in FIG. 2, the internal mechanism 12 is mainly formed inside an area sectioned by the frame 100 that is arranged backward and generally vertically and a pair of side face portions 110 and 111 that are extended from both ends of the frame 100 to the front parallel to each other, As shown in FIG. 2, in the internal mechanism 12, the carriage 200 is supported by a guide shaft 220 penetrating through the carriage. Both ends of the guide shaft 220 are supported by the side face portion 110 and the side face portion 111, and the guide shaft 220 is arranged parallel to the frame 100. Therefore, the carriage 200 can horizontally move along the guide shaft 220.

At the back of the carriage 200, a pair of pulleys 242 and 244 and a timing belt 230 that is hung on the pulleys 242 and 244 are arranged in the front of the frame 100. One pulley 244 is rotationally driven by a carriage motor 246. Moreover, the timing belt 230 is coupled to a rear portion of the carriage 200. Therefore, the carriage 200 can be reciprocated according to an operation of the carriage motor 246.

Moreover, the carriage 200 loads an ink cartridge 250, and also includes a recording head 210 in the lower part. The recording head 210 includes a nozzle plate 260 made of metal including openings to discharge ink droplets. Therefore, ink is discharged from the carriage 200 toward the lower side.

Furthermore, the carriage 200 is coupled with an electronic circuit 120 in the rear of the frame 100 via a tape-shaped multicore cable 270. Since the multicore cable 270 is flexibly bended according to a movement of the carriage 200, the multicore cable 270 does not disturb a reciprocation of the carriage 200.

The platen 400 is arranged on the lower side of an area along which the carriage 200 passes. The platen 400 supports the recording material 300 passing along a bottom of the carriage 200 from the lower side, in order to hold a distance between the nozzle plate 260 and the recording material 300 constant. Moreover, a concavity 410 is formed on a top face of the platen 400 and an absorbing member 420 is accommodated in the concavity 410. The absorbing member 420 receives ink discharged from the recording head 210 for an area on which the recording material 300 does not exist. In addition, a gap of around 2 to 4 mm is provided between the recording material 300 and the absorbing member 420 so that the recording material 300 does not come in contact with the absorbing member 420 to be not contaminated. Moreover, an interval of around 1 mm is provided between the surface of the nozzle plate 260 and the surfaces of the recording material 300.

In addition, as the operating time of the ink-jet type recording apparatus 11 elapses, ink is applied to the absorbing member 420. When the recording material 300 comes in contact with the absorbing member 420 to which ink is applied, the recording material 300 is contaminated with ink. Thus, since a protrusion-shaped portion is formed on a top face of the platen 400 to support the recording material 300 from the lower side, an interval between them is maintained to prevent them from being in contact with each other.

Moreover, since a material of the absorbing member 420 included within the platen 400 is selected in consideration of absorption velocity of liquid on the surface, absorption capacity is limited. Thus, a waste liquid absorbing member 600 having large absorption capacity is arranged on the lower side of the platen 400, and the absorbing member 600 comes in contact with the absorbing member 420. Since a material of the waste liquid absorbing member 600 is a material having large absorbing power by a capillary phenomenon in addition to the absorption capacity, it is possible to absorb a large quantity of ink from the absorbing member 420.

A carry-in roller 310 is arranged at the back of the platen 400. The carry-in roller 310 is driven by a carrying motor 320 arranged in the rear of the frame 100, and sends the recording material 300 onto the platen 400 in cooperation with a driven roller not shown. As described above, the carriage 200 can reciprocate in the direction perpendicular to a transportation direction of the recording material 300. Therefore, the transportation of the recording material 300 and the reciprocation of the carriage 200 can alternately be performed, whereas the recording head 210 on the undersurface of the carriage 200 can intermittently be operated to discharge and apply ink to an arbitrary area on the recording material 300.

Furthermore, in the internal mechanism 12, a cap member 500 is arranged at a lateral side of the platen 400 near the side face portion 110. The cap member 500 can move up and down, and thus ascends and seals a surface of the nozzle plate 260 when the carriage 200 stops at the home position near the side face portion 110. Moreover, an inside of the cap member 500 is coupled with a pump unit 510. The pump unit 510 can absorb ink applied to the surface of the nozzle plate 260. The ink absorbed by the pump unit 510 is absorbed into the waste liquid absorbing member 600 through a pipe not shown.

Furthermore, a wiping means 520 is arranged between the platen 400 and the cap member 500. When the carriage 200 released from the cap member 500 passes above the wiping means 520, the wiping means 520 wipes out the lower part of the nozzle plate 260 to clean it.

Figure 3:
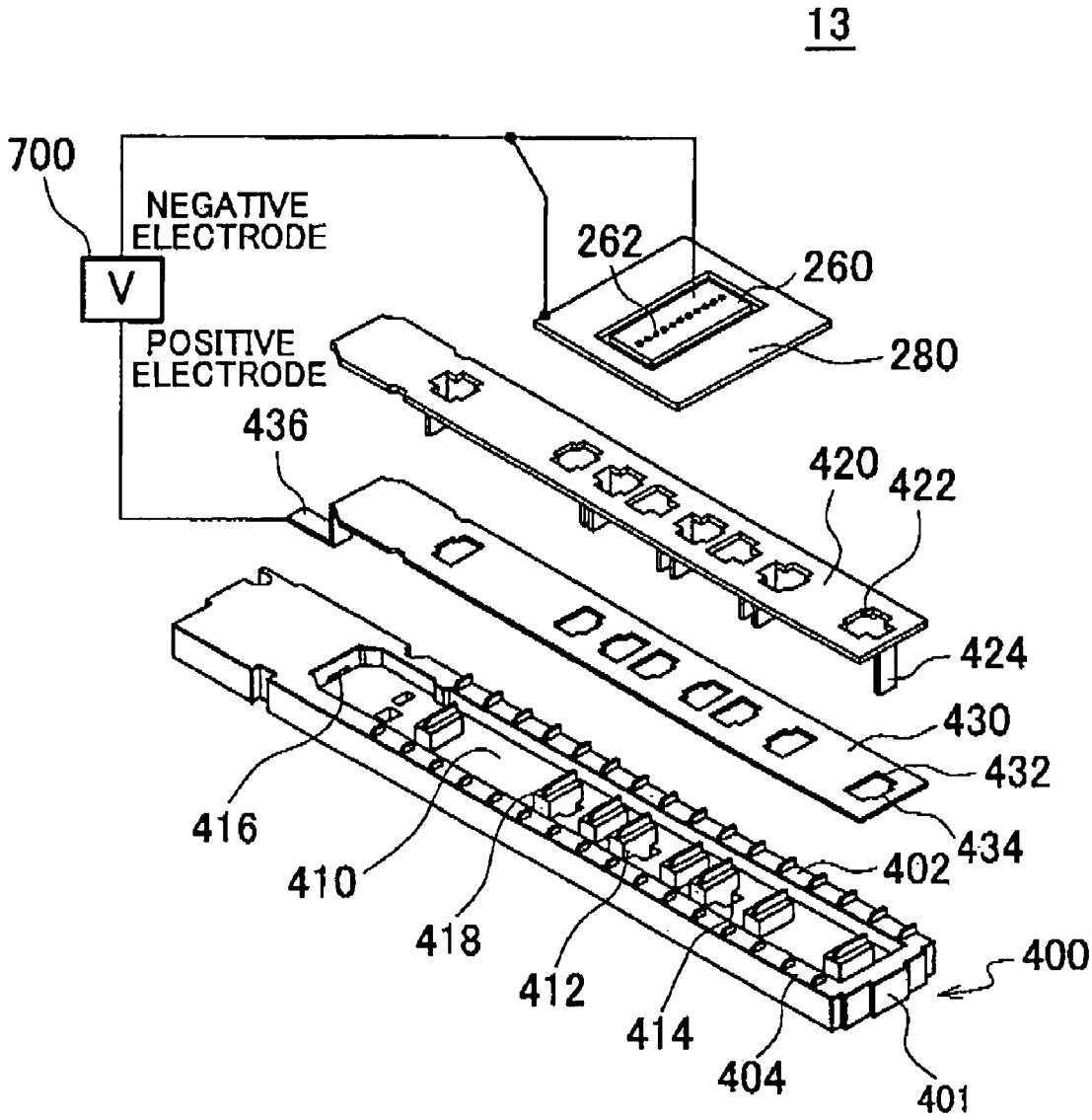
FIG. 3 is an exploded perspective view showing a satellite ink collecting mechanism.

FIG. 3 is an exploded perspective view minutely showing a configuration of a satellite ink collecting mechanism 13 including the platen 400 and the nozzle plate 260 used in the ink-jet type recording apparatus 11 shown in FIG. 1. Moreover, FIG. 3 shows the electrical relation between a platen-side member and a nozzle plate-side member.

As shown in FIG. 3, the platen 400 is formed of a plurality of members including a platen main body 401. The concavity 410 is formed on a top face of the platen main body 401, and further some insular portions 412 are formed in the concavity 410. Ribs 418 are respectively formed on edges 402 and 404 extended thinly and longitudinally on the concavity 410 and top faces on the insular portions 412. The ribs 418 are formed parallel to each other along the transportation direction of the recording-material 300, and supports the recording material 300 from the lower side at the ends thereof.

Moreover, a terminal inserting hole 416 for inserting a terminal portion 436 of a recording material side electrode 430 as described below is formed at an end of a bottom face of the concavity 410 similarly, foot inserting holes 414 for inserting foot portions 424 of the absorbing member 420 as described below are formed in the vicinity of the insular portions 412 on the bottom face of the concavity 410. The platen main body 401 including the insular portions 412, the ribs 418, the terminal inserting hole 416, and the foot inserting holes 414 can be shaped of injection molded resin in a unified body.

The recording material side electrode 430 is an electric conductor plate having the substantially same shape as that of the bottom face of the concavity 410 on the platen main body 401, and includes insular portion inserting holes 432 for inserting the insular portions 412 of the platen main body 401 and notches for foot insertion 434 for inserting the foot portions 424 of the absorbing member 420 as described below. Furthermore, a terminal portion 436 for coupling with a potential difference generating means 700 as described below is formed in one end of the recording material side electrode 430. The terminal portion 436 extends on the lower side from the recording material side electrode 430. Therefore, when the recording material side electrode 430 has been accommodated in the concavity 410, the bottom face of the platen main body 401 is covered by the recording material side electrode 430 over the generally entire surface, and further the terminal portion 436 is exposed to the outside of the platen main body 401 through the terminal inserting hole 416.

The recording material side electrode 430 as described above can be formed of metal with corrosion resistance against ink of the collar ink-jet type recording apparatus 11, for example, wire rod, plate, or foil material of gold, stainless steel, or nickel, or wire rod, plate, or foil material plated with these metals, or a net-like or lattice-like member made by combining these materials. Moreover, as another aspect, the recording material side electrode 430 can be formed of a film layer, a plating layer, a thick film layer, a thin film layer, or the like having electroconductivity, which is directly formed in the concavity 410 of the platen main body 401.

Furthermore, the absorbing member 420 has the substantially same surface configuration as the concavity 410. Moreover, the absorbing member 420 has insular portion inserting holes 422 for inserting the insular portions 412 of the platen main body 401 at the positions corresponding to the arrangement of insular portions 412. Moreover, the absorbing member 420 includes foot portions 424 respectively extending on the lower side from the edges of the insular portion inserting holes 422. Each foot portion 424 utilizes a part of a portion that becomes unnecessary to form the insular portion inserting hole 422, in order to be formed by downward bending the unnecessary-portion after shaping the absorbing member 420.

In addition, the absorbing member 420 directly receives ink not applied to the recording material 300 after being discharged from the nozzle plate 260. At this time, when absorption velocity of the absorbing member 420 is slow, so-called a milk crown phenomenon occurs due to an impact by which ink collides with the surface of the absorbing member 420. A minute ink drop occurs on the periphery of a milk crown, and the ink drop causes the generation of an aerosol. Thus, a foaming material having high percentage of voids is selected as a material of the absorbing member 420 in serious consideration of the height of absorption velocity.

Moreover, the absorbing member 420 can be formed of a conductive material having a resistance value of surface resistance less than or equal to $10^8\Omega$. Specifically, a material made by mixing a conductive material such as metal and carbon with resin such as polyethylene and polyurethane, a material made by applying a conductive material such as metal and carbon to a resin foaming material such as polyethylene and polyurethane, or a material made by plating resin can be used as the absorbing member. Moreover, a material made by impregnating a resin foaming material such as polyethylene and polyurethane with an electrolytic solution can be used as the absorbing member 420.

The absorbing member 420 as described above is superimposed on the recording material side electrode 430 and is accommodated within the concavity 410 of the platen main body 401. At this time, the foot portions 424 are inserted into the notches for foot insertion 434 of the recording material side electrode 430 and the foot inserting holes 414 of the platen main body 401 to be extended on the lower side of the platen main body 401, and bottom ends of the foot portions contacts with the waste liquid absorbing member 600 shown in FIG. 2.

Furthermore, the ink-jet type recording apparatus 11 includes a nozzle plate side electrode 280 mounted to surround the nozzle plate 260 on the substantially same plane surface as the nozzle plate 260 having a plurality of openings 262. The nozzle plate side electrode 280 is electrically coupled with the nozzle plate 260 and simultaneously is coupled with the recording material side electrode 430 via the potential difference generating means 700. Therefore, the constant potential difference V is formed between both of the nozzle plate 260 and the nozzle plate side electrode 280 and the recording material side electrode 430. In addition, in the present embodiment as shown in FIG. 3, the recording material side electrode 430 is connected to a positive electrode of the potential difference generating means 700 and the nozzle plate 260 and the nozzle plate side electrode 280 are connected to a negative electrode of the potential difference generating means 700. However, a similar function can be realized even if all polarities, are inverted and connected.

Here, the recording material side electrode 430 covers the substantially whole bottom face of the concavity 410 of the platen main body 401, and the absorbing member 420 having the generally same shape as the recording material side electrode is superimposed and accommodated thereupon. In this manner, since the whole lower part of the absorbing member 420 touches the recording material side electrode 430, the whole absorbing member 420 has uniform electric potential generally equal to the recording material side electrode 430 even if it is assumed that electrically discontinuous portions are in the internal structure of the absorbing member 420. In this way, an electric field corresponding to the potential difference V, e.g., an electric field greater than or equal to 25 kV/m is formed between both of the nozzle plate 260 and the nozzle plate side electrode 280 and the surface of the absorbing member 420.

Figure 4:
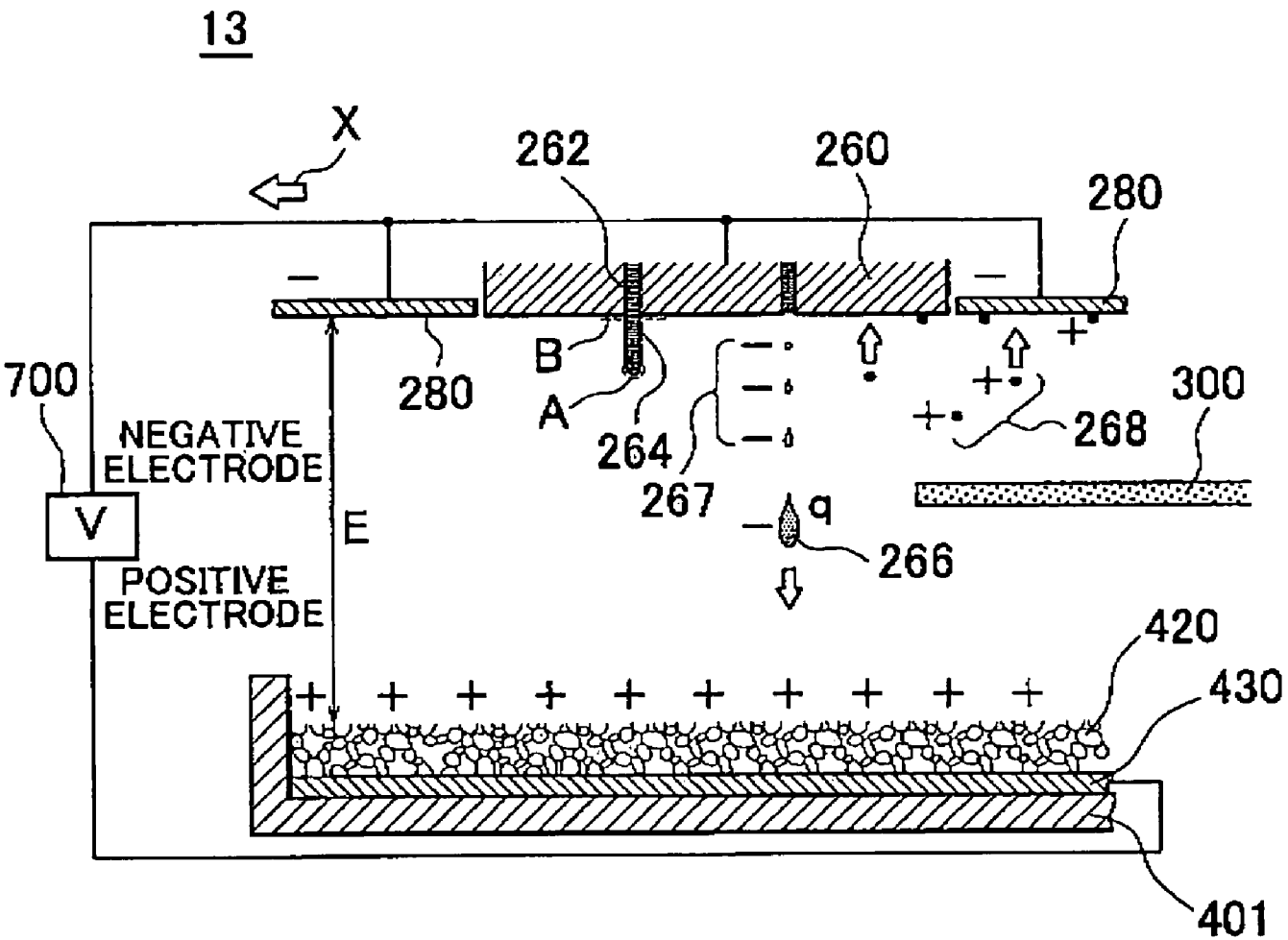
FIG. 4 is a side view showing a satellite ink collecting mechanism shown in FIG. 3.

FIG. 4 is a conceptual diagram showing an enlarged view of the periphery of the nozzle plate 260 during an operation in the satellite ink collecting mechanism 13 shown in FIG. 3. In FIG. 4, the same components as those of FIGS. 1 to 3 have the same reference numerals, and their descriptions will be omitted.

As shown in FIG. 4, the plurality of openings 262 for discharging ink is formed in the nozzle plate 260. Moreover, as shown with an arrow X in FIG. 4, the nozzle plate 260 moves from right to left on the present drawing with the movement of the carriage 200.

When the recording material 300 exists right under the nozzle plate 260, an ink drop 266 discharged from the opening 262 of the nozzle plate 260 is applied to the recording material 300. However, when applying ink to edges of the recording material 300 without white space, in side edges and front and rear ends of the recording material 300, the recording material 300 does not exist right under a part of the openings 262.

In this case, a kinetic energy given to the ink drop 266 by the discharge from the opening 262 is rapidly lost by viscous resistance of an atmosphere, and a part of the ink drop 266 is completely lost along time before arriving at the absorbing member 420. Moreover, since mass of the ink drop 266 is small extremely, a falling motion by acceleration of gravity and the viscous resistance force balance each other, and fall velocity of the ink drop 266 becomes extremely late. In this way, there is generated an aerosol floating on the lower side of the nozzle plate 260. Moreover, when ink is discharged from the opening 262 of the nozzle plate 260, a part of the ink drop 266 breaks off, and satellite ink 267 and 268 that is more minute ink drop is generated.

Moreover, as already described with reference to FIG. 3, an electric field E is formed between the nozzle plate 260 and the absorbing member 420 in the ink-jet type recording apparatus 11. The ink pushed out from the opening 262 in the ink-jet type recording apparatus 11 becomes an ink pillar 264 drooping from the nozzle plate 260 at the moment just before the ink becomes the ink drop 266. At this time, electric charges are accumulated by so-called lightning conductor effect between a leading end A of the ink pillar 264 and the lower part of the nozzle plate 260 on an area B in the vicinity of the ink pillar 264. That is, the above lightning conductor effect means that the area B on the surface of the nozzle plate 260 surrounded with a conical shape including a range of a vertex angle from 50° to 60° with the leading end A (a bottom end in the present drawing) of the ink pillar 264 at the top contributes to the charge of the ink drop 266. By this lightning conductor effect, the ink drop 266 has an electric charge larger than an electric charge corresponding to a horizontal cross section of the ink pillar 264.

The ink pillar 264 becomes the ink drop 266 apart from the nozzle plate 260 before long. However, this ink drop 266 is charged with an electric charge q accumulated by the lightning conductor effect as described above. Therefore, the ink drop 266 having the charge q obtains a kinetic energy by a coulomb force Fe (qE) from an electric field E, and thus moves on the lower side without deceleration to finally arrive at the absorbing member 420.

Furthermore, the satellite ink includes the satellite ink 267 charged with charges with the same polarity as that of the ink drop 266 and the satellite ink 268 charged with charges with the polarity opposite to that of the ink drop 266. The satellite ink 267 charged with charges with the same polarity as that of the ink drop 266 is directed to the absorbing member 420 side without being decelerated by a coulomb force forced by the electric field E, and is absorbed into the absorbing member 420 before long. On the other hand, the satellite ink 268 charged with charges with the polarity opposite to that of the ink drop 266 is adsorbed to the nozzle plate 260 or the nozzle plate side electrode 280 having electric potential opposite to the ink 268.

In addition, as described above, the nozzle plate 260 discharges ink while moving in the direction of an arrow X. Moreover, viscous resistance of an atmosphere against a minute droplet is large extremely. For this reason, the satellite ink 267 and 268 generated as above gets left behind the movement direction of the nozzle plate 260. Therefore, the satellite ink 268 charged with charges with the polarity opposite to that of the ink drop 266 is largely adsorbed to the nozzle plate side electrode 280 behind the movement direction, compared with the nozzle plate 260. Moreover, for, convenience, in the present drawing, the nozzle plate 260 is described as "–" and the recording material 300 is described as "+". However, although electric potential is formed by inverting all polarities, a similar effect is obtained.

Moreover, the satellite ink 268 collected in the nozzle plate 260 and the nozzle plate side electrode 280 is finally lost by the wiping means 520. Therefore, it is preferable that the lower part of the nozzle plate 260 and the lower part of the nozzle plate side electrode 280 are arranged on the same plane. Here, the nozzle plate side electrode 280 may slightly retreat from the nozzle plate 260 with respect to the wiping means 520. In this way, the wiping means 520 can wipe the nozzle plate 260 more surely during wiping.

Figure 5:
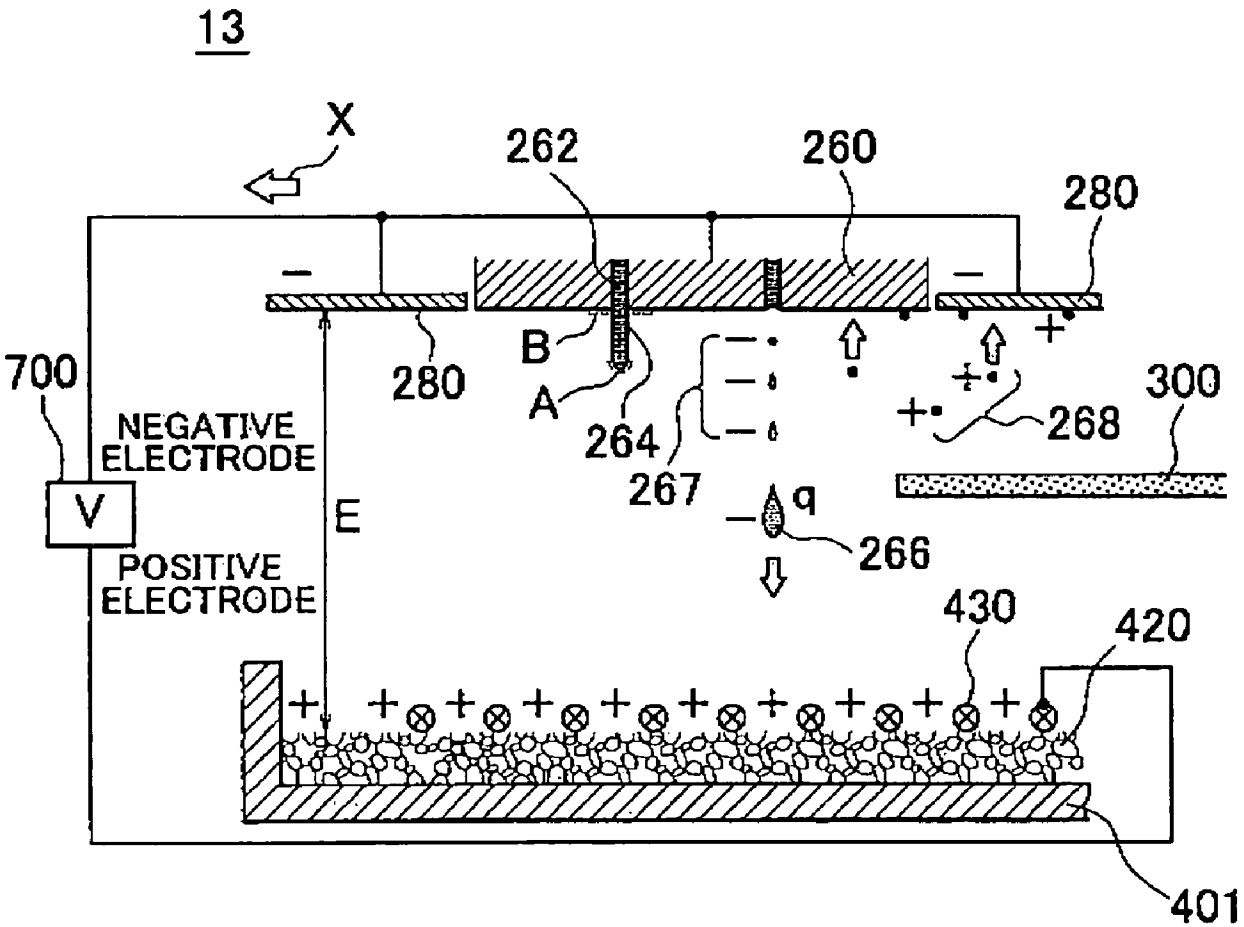
FIG. 5 is a side view showing another embodiment of a satellite ink collecting mechanism.

FIG. 5 is a view showing the satellite ink collecting mechanism 13 as another embodiment of an ink injection system. In addition, in FIG. 5, the same components as those of FIG. 4 have the same reference numerals, and their descriptions will be omitted.

As shown in FIG. 5, in the present embodiment, the layouts of the nozzle plate 260, the nozzle plate side electrode 280, the absorbing member 420, the platen main body 401, and the potential difference generating means 700 are common with the devices shown in FIG. 4. A feature of the present embodiment is a configuration and arrangement of the recording material side electrode 430. That is, the recording material side electrode 430 used in this embodiment is formed of a net-like member mounted on a top face of the absorbing member 420, and is electrically connected to the potential difference generating means 700.

Here, a material of the recording material side electrode 430 can include metal having corrosion resistance against ink of the ink-jet type recording apparatus 11, e.g., gold, stainless steel, nickel, or the like, or a material made by plating copper with these metal. Moreover, a member to be used in the recording material side electrode 430 can include a member made by arraying wire rod or plate material having a diameter of about 0.1 mm to 0.5 mm formed of these materials parallel to one another at intervals of around 0.5 mm from 4 mm, or a member made by forming wire rod or plate material in a reticular pattern. Furthermore, it is preferable that a member to be used as the recording material side electrode 430 has a passage area with the magnitude enough to pass incoming ink to the absorbing member 420.

By such a configuration, in the satellite ink collecting mechanism 13, the satellite ink 267 charged with charges having the same polarity as that of the ink drop 266 is directed to the absorbing member 420 by a coulomb force forced by an electric field E to be adsorbed to the recording material side electrode 430 without deceleration. However, the adsorbed ink is sucked into the absorbing member 420 that is arranged adjacently to the recording material side electrode 430 before long. On the other hand, the satellite ink 268 charged with charges having the polarity opposite to the ink drop 266 is adsorbed to the nozzle plate 260 or the nozzle plate side electrode 280 having electric potential opposite to the ink 268. In addition, in the present embodiment, as shown in the present drawing, the recording material side electrode 430 is connected to a positive electrode side of the potential difference generating means 700 and the nozzle plate 260 and the nozzle plate side electrode 280 are connected to a negative electrode side of the potential difference generating means 700. However, although all polarities are inverted, a similar function can be realized.

Figure 6:
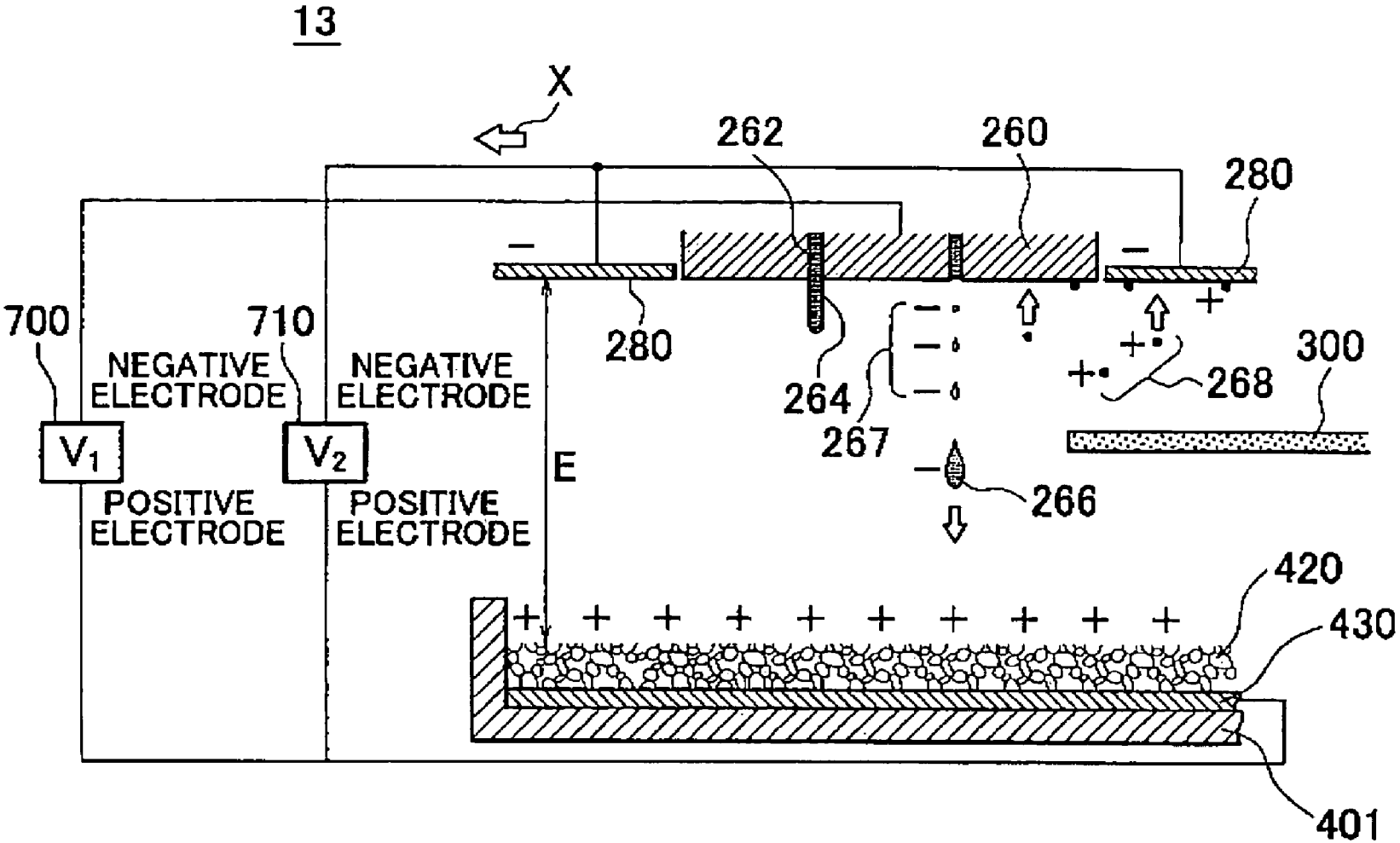
FIG. 6 is a side view showing further another embodiment of a satellite ink collecting mechanism.

FIG. 6 is a view showing the satellite ink collecting mechanism 13 as another embodiment of the ink injection system. In addition, in FIG. 6, the same components as those of FIG. 4 have the same reference numerals, and their descriptions will be omitted.

As shown in the present drawing, in the present embodiment, the physical layouts of the nozzle plate 260, the nozzle plate side electrode 280, the absorbing member 420, the recording material side electrode 430, and the platen main body 401 are common to the devices shown in FIG. 4, and the feature is a electrically connected state. That is, the ink-jet type recording apparatus 11 includes the potential difference generating means 700 for forming a potential difference $V_1$ between the nozzle plate 260 and the recording material side electrode 430 and a potential difference generating means 710 for forming a potential difference $V_2$ between the recording material side electrode 430 and the nozzle plate side electrode 280. In addition, in the present embodiment, as shown in the present drawing, the recording material side electrode 430 is connected to positive electrode sides of the potential difference generating means 700 and the potential difference generating means 710 and the nozzle plate 260 and the nozzle plate side electrode 280 are connected to negative electrode sides of the potential difference generating means 700 and the potential difference generating means 710. However, although all polarities are inverted, a similar function can be realized.

By such a configuration, in the satellite ink collecting mechanism 13, since the potential difference generating means 700 for the nozzle plate 260 and the potential difference generating means 710 for the nozzle plate side, electrode 280 are separated from each other, an electric field E can stably be generated between the nozzle plate 260 and the recording material side electrode 430, even if a large quantity of satellite ink 268 is adsorbed to the nozzle plate side electrode 280 and thus an electric characteristic is changed.

Furthermore, since the potential difference $V_2$ generated by the potential difference generating means 710 is set larger than the potential difference $V_1$ generated by the potential difference generating means 700, the potential of the nozzle plate side electrode 280 can be set higher while having the same polarity as that of the nozzle plate 260, and thus the satellite ink 268 charged with charges having the polarity opposite to the nozzle plate 260 can strongly be absorbed.

Figure 7:
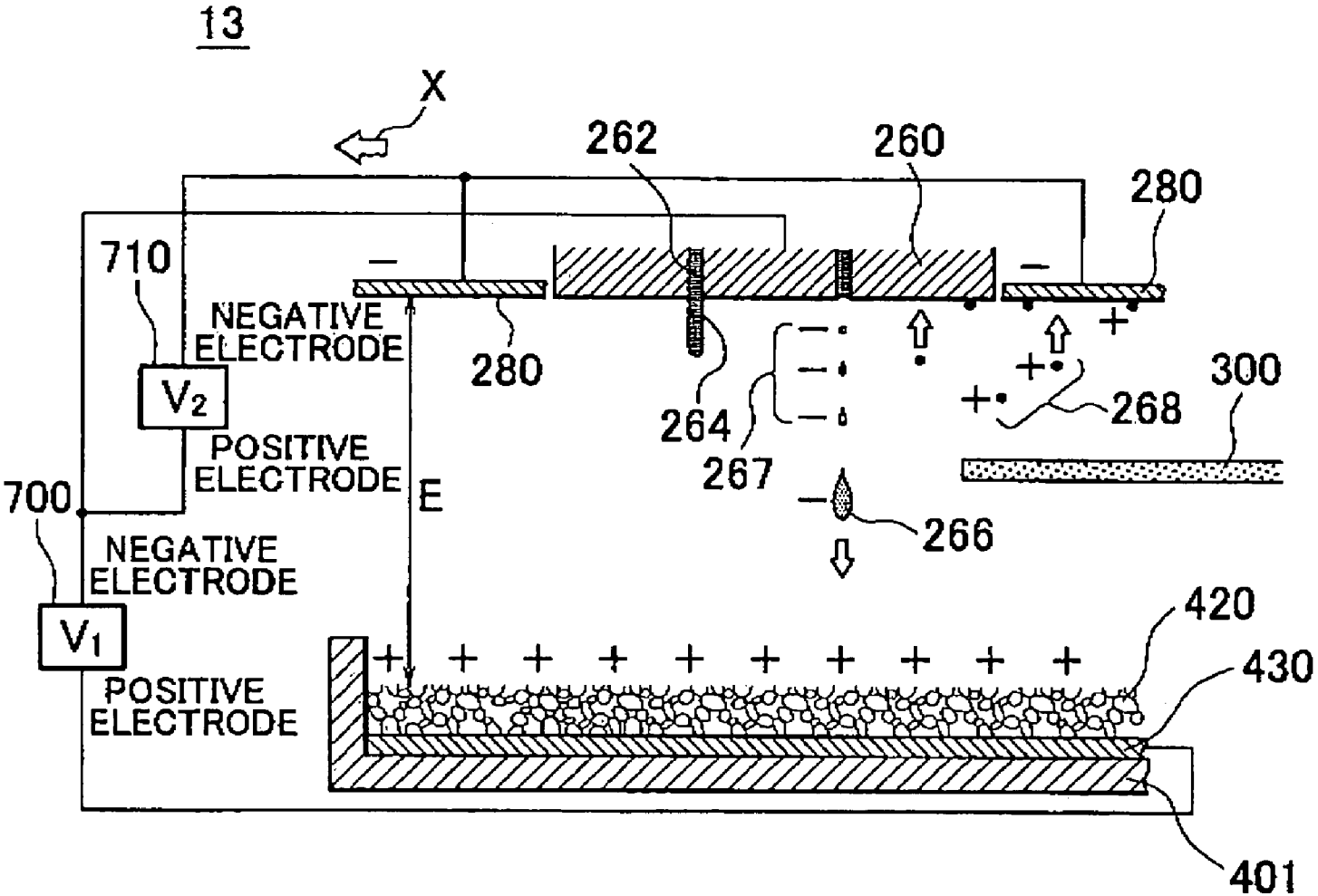
FIG. 7 is a side view showing further another embodiment of a satellite ink collecting mechanism.

FIG. 7 is a view showing the satellite ink collecting mechanism 13 as further another embodiment of the ink-jet type recording apparatus 11. In addition, in FIG. 7, the same components as those of FIGS. 4 to 6 have the same reference numerals, and their descriptions will be omitted.

As shown in the present drawing, in the present embodiment, the feature is an electrically connected state. That is, in the satellite ink collecting mechanism 13, the potential difference generating means 700 is connected between the nozzle plate 260 and the recording material side electrode 430 in order to generate the potential difference $V_1$. On the other hand, in the potential difference generating means 710, one end is connected to the nozzle plate 260 side of the potential difference generating means 700 and the other end is connected to the nozzle plate side electrode 280. Therefore, a potential difference between the recording material side electrode 430 and the nozzle plate side electrode 280 is $(V_1+V_2)$. In addition, in the present embodiment, as shown in the present drawing, the recording material side electrode 430 is connected to a positive electrode side of the potential difference generating means 700, positive electrode sides of the nozzle plate 260 and the potential difference generating means 710 are connected to a negative electrode side of the potential difference generating means 700, and the nozzle plate side electrode 280 is connected to a negative electrode side of the potential difference generating means 710. However, although all polarities are inverted, a similar function can be realized.

By such a configuration, in the ink-jet type recording apparatus 11, the nozzle plate side electrode 280 can collect a larger amount of aerosol than the nozzle plate 260 similarly to an embodiment shown in FIG. 4. Moreover, in the embodiment, the potential of the nozzle plate side electrode 280 is always high by $V_2$ with respect to the potential of the nozzle plate 260. Therefore, the nozzle plate side electrode 280 can absorb the satellite ink 268 more strongly. Moreover, since the potential difference generated by the potential difference generating means 710 is only the difference between the potential of the nozzle plate 260 and the potential of the nozzle plate side electrode 280, the potential difference can be realized without using a circuit generating a high voltage.

Figure 8:
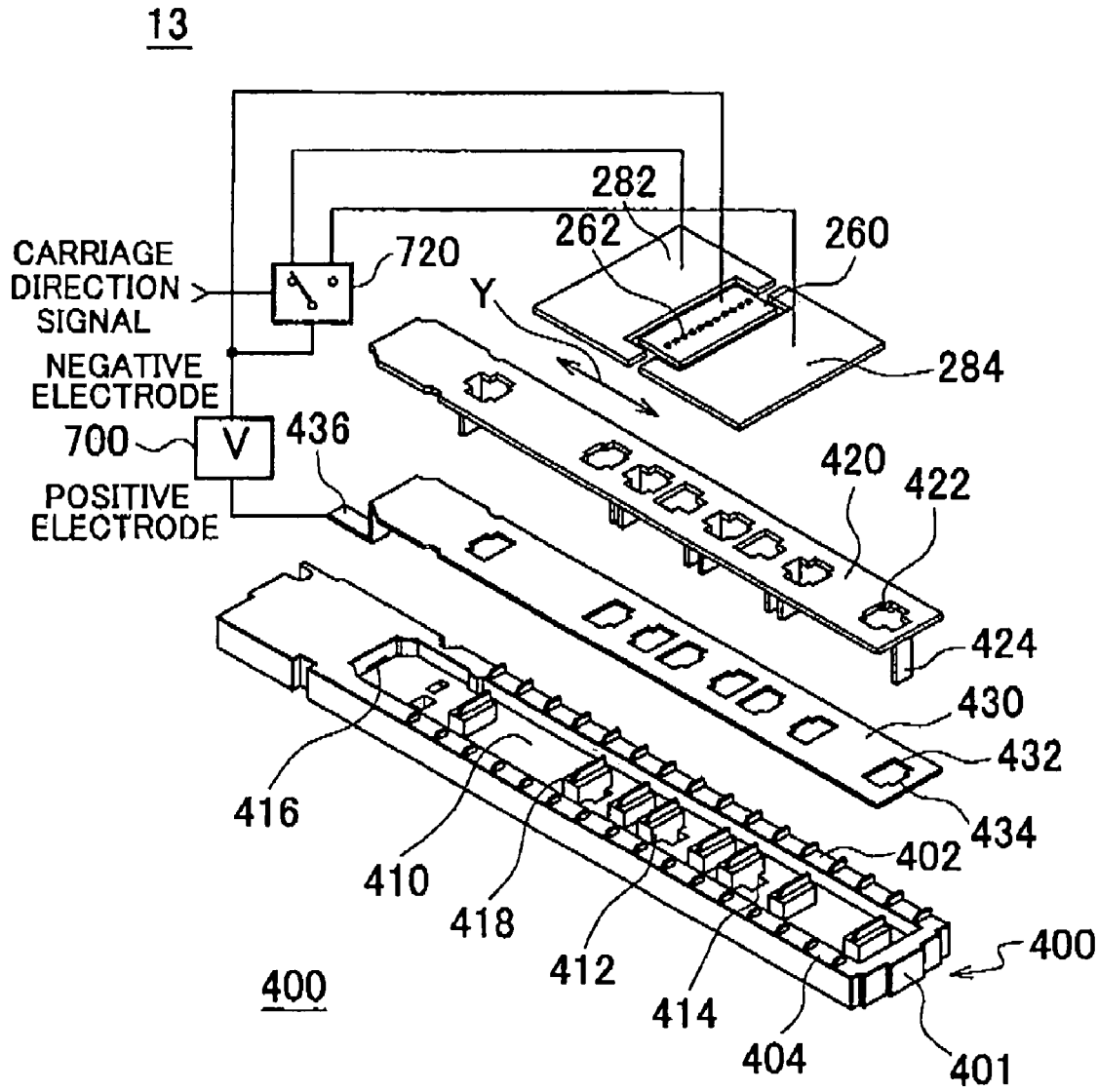
FIG. 8 is an exploded perspective view showing a different embodiment of a satellite ink collecting mechanism.

FIG. 8 is a view showing the satellite ink collecting mechanism 13 as further another embodiment in association with FIG. 3. In FIG. 8, the same components as those of FIG. 3 have the same reference numerals, and their descriptions will be omitted. As shown in FIG. 8, in the present embodiment, an electrode of the nozzle plate 260 is formed of a pair of nozzle plate side electrodes 282 and 284 that are separated from each other while holding the nozzle plate 260 therebetween. Here, the movement direction of the nozzle plate 260 is shown with an arrow Y in the present drawing. However, during moving the nozzle plate 260, either of the nozzle plate side electrodes 282 and 284 precedes or follows the nozzle plate 260.

Moreover, in the present embodiment, the satellite ink collecting mechanism 13 includes the potential difference generating means 700 of which one end is connected to the recording material side electrode 430. The other end of the potential difference generating means 700 is directly connected to the nozzle plate 260, and is individually connected to the nozzle plate side electrodes 282 and 284 via the switching means 720. In addition, in the present embodiment, as shown in the present drawing, the recording material side electrode 430 is connected to a positive electrode side of the potential difference generating means 700 and the nozzle plate 260 and the switching means 720 are connected to a negative electrode side of the potential difference generating means 700. However, although all polarities are inverted, a similar function can be realized.

The switching section 720 is controlled based on a carriage direction signal instructing the movement direction of the carriage 200 that carries the nozzle plate 260, and couples only the nozzle plate side electrode (either of 282 or 284) near the side following the nozzle plate 260 with the potential difference generating means 700. Therefore, while the potential difference of a voltage V is always generated between the nozzle plate 260 and the recording material side electrode 430, only either of the nozzle plate side electrodes 282 and 284 has the same potential as that of the nozzle plate 260.

Figure 9:
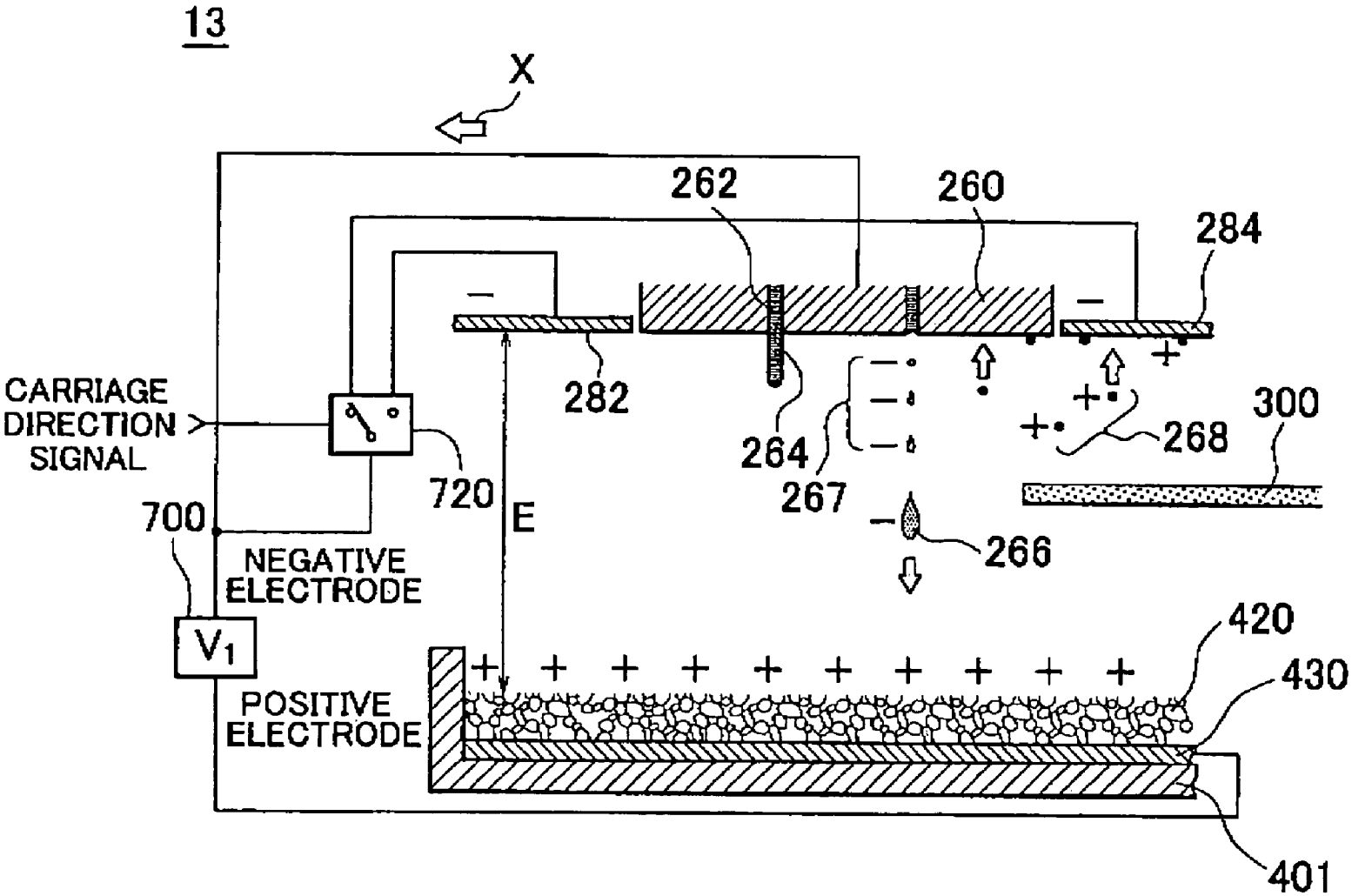
FIG. 9 is a side view showing a satellite ink collecting mechanism shown in FIG. 8.

FIG. 9 is a conceptual diagram showing the satellite ink collecting mechanism 13 of which the periphery of the nozzle plate 260 is magnified, in order to explain operations of an embodiment as shown in FIG. 8. In the present drawing, the same components as those of the other drawings have the same reference numerals, and their descriptions will be omitted.

In the present drawing, the nozzle plate 260 discharges ink while moving in the direction of an arrow X. Moreover, as described above, since viscous resistance of an atmosphere extremely influences a minute ink drop, the satellite ink 267 and 268 generated on the lower side of the nozzle plate 260 gets always left behind the movement direction of the nozzle plate 260. Here, in the present embodiment, when the nozzle plate 260 moves in the direction of an arrow x, since the potential difference generating means 700 is connected to the nozzle plate side electrode 284 via a switching means 720, the nozzle plate side electrode 284 has the same potential as that of the nozzle plate 260. Moreover, since the nozzle plate side electrode 284 moves in chase of the nozzle plate 260, the nozzle plate side electrode 284 lets left behind after the movement of the nozzle plate 260, and thus can efficiently adsorb the satellite ink 268 charged with charges having the polarity opposite to that of the nozzle plate 260.

In this manner, in the present embodiment, the ink-jet type recording apparatus 11 includes the switching means 720 and a pair of nozzle plate side electrodes 282 and 284 arranged before and behind along the movement direction of the nozzle plate 260. Moreover, the switching means 720 selectively connects the potential difference generating means 700 to one nozzle plate side electrode 284 arranged behind along the movement direction of the nozzle plate 260. Therefore, the nozzle plate side electrode 284 can adsorb the satellite ink 268, which is charged with charges having the polarity opposite to that of the nozzle plate 260 and gets left behind the nozzle plate 260, using a limited-electric power efficiently.

Figure 10:
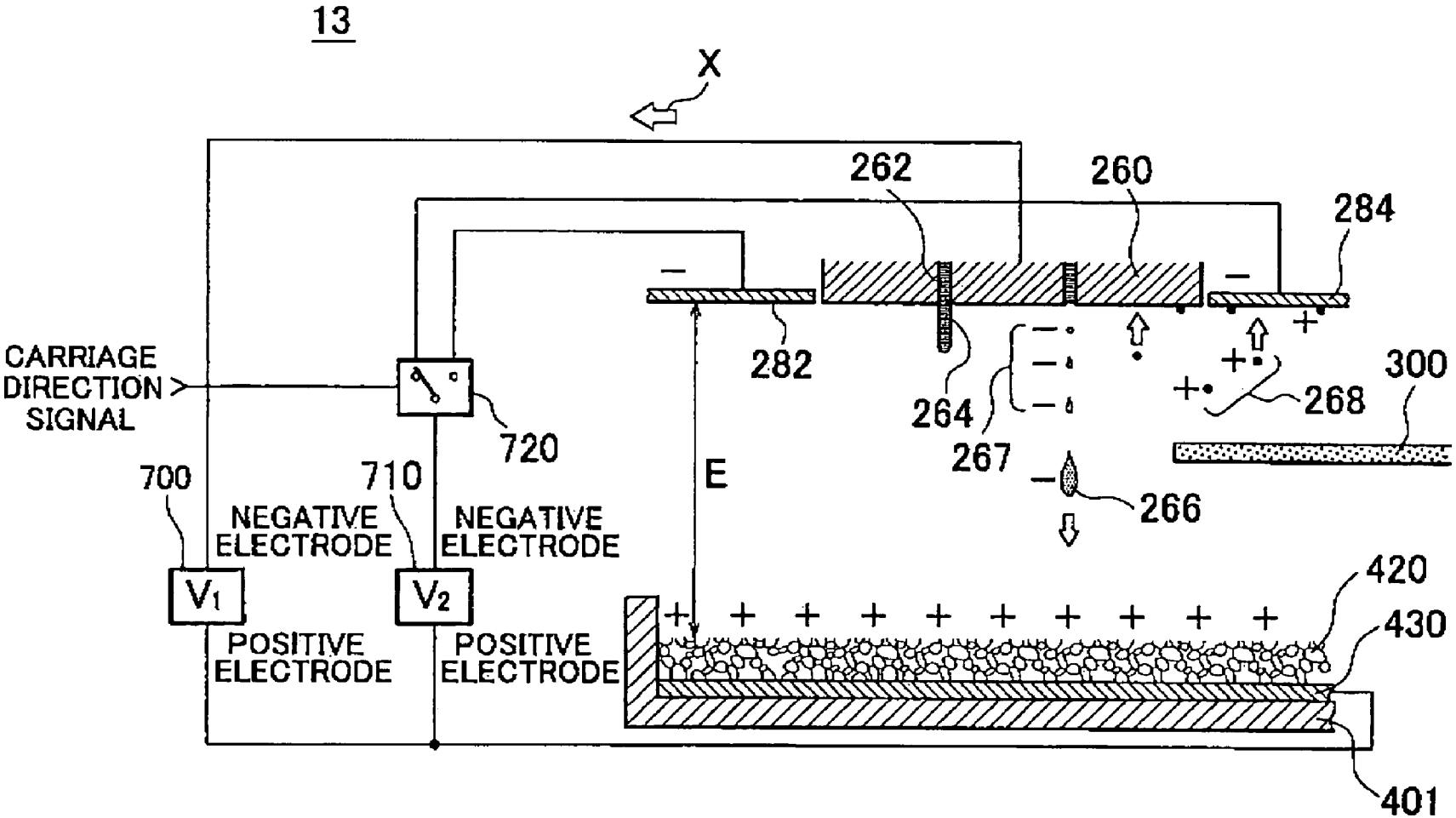
FIG. 10 is a side view showing further another embodiment of a satellite ink collecting mechanism.

FIG. 10 is a view showing the satellite ink collecting mechanism 13 as further another embodiment. In FIG. 10, the same components as those of the other embodiments have the same reference numerals, and their descriptions will be omitted. As shown in the present drawing, the satellite ink collecting mechanism 13 of the embodiment has a configuration in which the potential difference generating means 700 and 710 shown in FIG. 6 are added to the ink-jet type recording apparatus 11 including the switching means 720 shown in FIGS. 8 and 9.

That is, in the present embodiment, the ink-jet type recording apparatus 1*b* includes the two potential difference generating-means 700 and 710 and the switching means 720. One potential difference-generating means 700 is coupled between the recording material side electrode 430 and the nozzle plate 260, and always forms the potential difference $V_1$ between them. On the contrary, the other potential difference generating means 710 connects the recording material side electrode 430 and a pair of the nozzle plate side electrodes 282 and 284 via the switching means 720. Here, the switching section 720 is controlled based on a carriage direction signal, and couples only the nozzle plate side electrodes 282 and 284 near the side following the nozzle plate 260 with the potential difference generating means 710. Therefore, the nozzle plate side electrodes 282 and 284 have the same polarity as that of the nozzle plate 260 by only the period for which they move in chase of the nozzle plate 260. In addition, in the present embodiment, as shown in the present drawing, the recording material side electrode 430 is connected to a positive electrode side of the potential difference generating means 700, a positive electrode side of the potential difference generating means 710 is connected to a negative electrode side of the potential difference generating means 700, the nozzle plate 260 is connected to the negative electrode side of the potential difference generating means 700, and the switching means 720 is connected to a negative electrode side of the potential difference generating means 710. However, although all polarities are inverted, a similar function can be realized.

By such a configuration, in the satellite ink collecting mechanism 13, since the potential difference generating means 700 for the nozzle plate 260 and the potential difference generating means 710 for the nozzle plate side electrodes 282 and 284 are separated from each other, an electric field E can stably be generated between the nozzle plate 260 and the recording material side electrode 430 even if a large quantity of satellite ink 268 is adsorbed to the nozzle plate side electrodes 282 and 284 to cause the change of an electric characteristic.

Moreover, in this configuration, since the potential difference $V_2$ generated by the potential difference generating means 710 is set larger than the potential difference $V_1$ generated by the potential difference generating means 700, the potential of the nozzle plate side electrodes 282 and 284 can be set higher while having the same polarity as that of the nozzle plate 260, and thus the satellite ink 268 charged with charges having the polarity opposite to the nozzle plate 260 can strongly be absorbed. Moreover, since the potential difference generating means 710 is selectively connected to the nozzle plate side electrodes 282 and 284, the satellite ink 268 can be adsorbed using a limited electric power efficiently.

Figure 11:
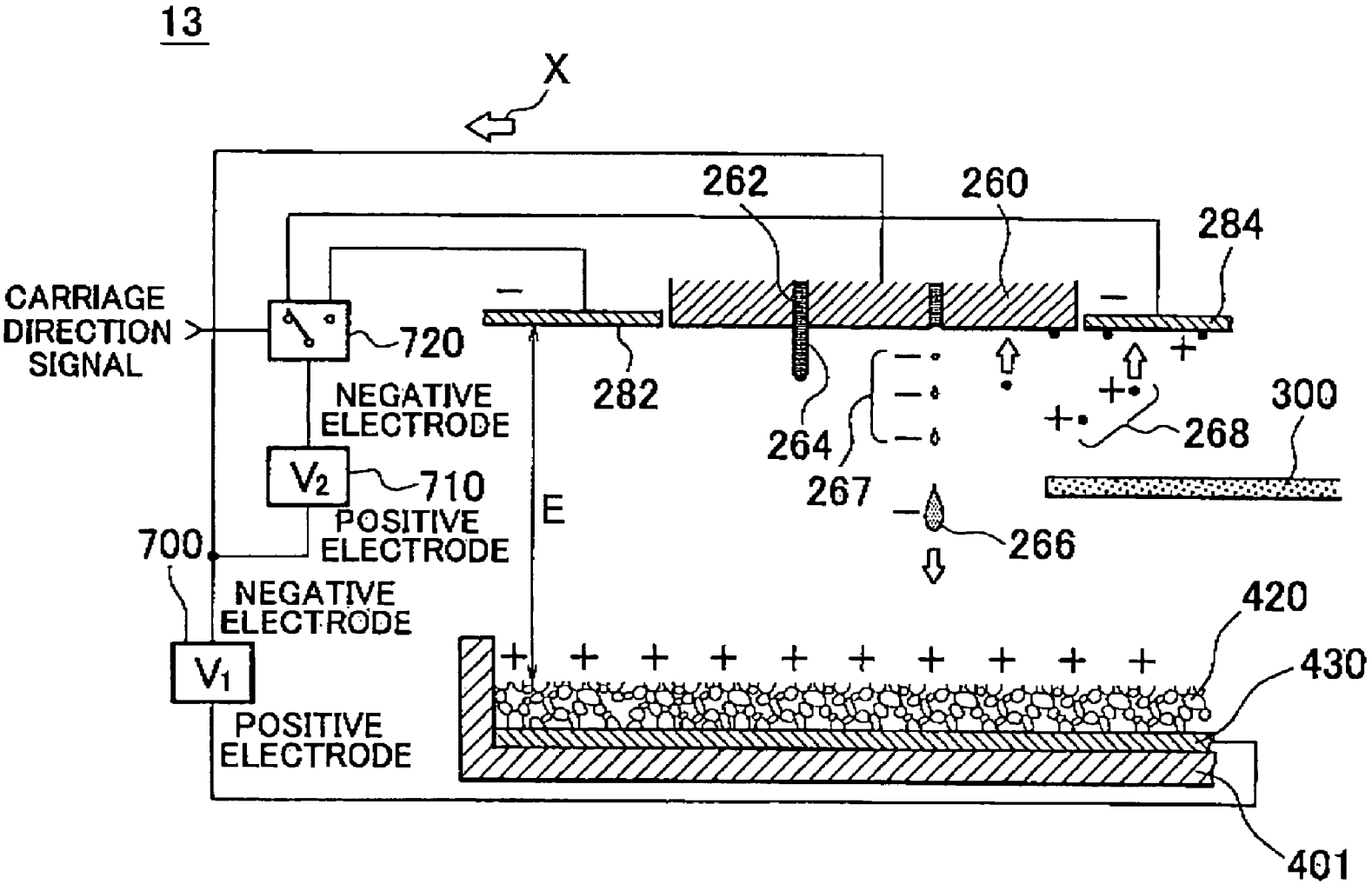
FIG. 11 is a side view showing further another embodiment of a satellite ink collecting mechanism.

FIG. 11 is a view showing the satellite ink collecting mechanism 13 as further another embodiment. In FIG. 11, the same components as those of the other embodiments have the same reference numerals, and their descriptions will be omitted. As shown in the present drawing, the satellite ink collecting mechanism 13 of the embodiment has a configuration in which the potential difference generating means 710 serially connected shown in the present drawing is added to the ink-jet type recording apparatus 11 including the switching means 720 shown in. FIGS. 8 and 9. In addition, in the present embodiment, as shown in the present drawing, the recording material side electrode 430 is connected to a positive electrode side of the potential difference generating means 700, positive electrode sides of the nozzle plate 260 and the potential difference generating means 710 are connected to a negative electrode side of the potential difference generating means 700, and the switching means 720 is connected to a negative electrode side of the potential difference generating means 710. However, although all polarities are inverted, a similar function can be realized.

In the present embodiment, the ink-jet type recording apparatus 11 includes the two potential difference generating means 700 and 710 and the switching means 720. One potential difference generating means 700 is directly coupled between the recording material side electrode 430 and the nozzle plate 260, and always forms the potential difference $V_1$ between them. On the contrary, the other potential difference generating means 710 is connected to one end of the potential difference generating means 700 and further is connected to the nozzle plate side electrodes 282 and 284 via the switching means 720. Here, the switching section 720 is controlled based on a carriage direction signal, and couples only the nozzle plate side electrode near the side following the nozzle plate 260 with the potential difference generating means 710. Therefore, the nozzle plate side electrodes 282 and 284 have the potential difference $V_2$ of the same polarity as that of the nozzle plate 260 by only the period for which they move in chase of the nozzle plate 260.

By such a configuration, in the satellite ink collecting mechanism 13, since the potential difference generating means 700 for the nozzle plate 260 and the potential difference generating means 710 for the nozzle plate side electrodes 282 and 284 are separated from each other, an electric field E can stably be generated between the nozzle plate 260 and the recording material side electrode 430 even if a large quantity of satellite ink 268 is adsorbed to the nozzle plate side electrodes 282 and 284 to cause the change of an electric characteristic.

Moreover, in the present embodiment, the potential of the nozzle plate side electrodes 282 and 284 becomes high by $V_2$ with, respect to the potential of the nozzle plate 260. Therefore, the nozzle plate side electrodes 282 and 284 can absorb the satellite ink 268 more strongly. Moreover, since the potential difference generated by the potential difference generating means 710 is only the difference between the potential of the nozzle plate 260 and the potential of the nozzle plate side electrodes 282 and 284, it can be realized without using a circuit generating a high voltage. Furthermore, since the potential difference generating means 710 is selectively connected to the nozzle plate side electrodes 282 and 284, adsorption can be performed using a limited electric power efficiently.

As discussed in detail above, since the liquid ejecting apparatus can actively collect an aerosol charged with charges having the polarity opposite to that of the nozzle plate, various kinds of problems caused by the aerosol can be solved.

In addition, as an operative example of an embodiment of the present invention, although the liquid ejecting apparatus can include a color material injection system in manufacture of a color filter for a liquid crystal display, an electrode formation apparatus in manufacture of an organic EL display, FED (a plane emission display), or the like, and a sample injection head used in manufacture of a biochip, the liquid ejecting apparatus is not limited to them, Although the present invention has been described by way of an exemplary embodiment, it should be understood that those skilled in the art might make many changes and substitutions without departing from the spirit and the scope of the present invention. It is obvious from the definition of the appended claims that embodiments with such modifications also belong to the scope of the present invention.

What is claimed is:

1. A liquid ejecting apparatus comprising:

a liquid ejecting head that has a conductive nozzle plate having openings and discharges liquid drops from the openings of the nozzle plate while reciprocating above recording material;

a recording material side electrode that is arranged farther than the recording material opposite the nozzle plate in a direction in which the liquid is discharged;

a potential difference generating means that generates a potential difference between the nozzle plate and said recording material side electrode to electrically attract the liquid drops discharged from the openings of the nozzle plate toward said recording material side electrode; and a nozzle plate side electrode that is arranged adjacent to said nozzle plate in a direction of reciprocation of the nozzle plate and has a potential difference of the same polarity as that of the nozzle plate.

2. The liquid ejecting apparatus as claimed in claim 1, wherein said nozzle plate side electrode is mounted substantially on the same plane surface as the nozzle plate.

3. The liquid ejecting apparatus as claimed in claim 1, wherein said nozzle plate side electrode retreats from the nozzle plate in the direction in which the liquid drops are discharged.

4. The liquid ejecting apparatus as claimed in claim 1, wherein said nozzle plate side electrode has a pair of electrode pieces arranged to be electrically detached from each other in the direction of reciprocation while holding the nozzle plate therebetween, and the liquid ejecting apparatus further comprises a switching means that electrically connects said potential difference generating means to one of said electrode pieces of said nozzle plate side electrode located on a side pursuing a movement of the nozzle plate in the direction of reciprocation of the nozzle plate and electrically disconnects said potential difference generating means from the other of said electrode pieces.

5. The liquid ejecting apparatus as claimed in claim 1, wherein the potential of the nozzle plate side electrode is set higher than that of the nozzle plate.

6. The liquid ejecting apparatus as claimed in claim 5, wherein said potential difference generating means comprises:

a first potential difference generating unit which supplies a first potential difference to said nozzle plate; and a second potential difference generating unit which supplies a second potential difference to said nozzle plate side electrode, and said second potential difference is higher than said first potential difference.

7. The liquid ejecting apparatus as claimed in claim 6, wherein said nozzle plate side electrode is supplied with the potential difference from both said first and second potential difference generating units.

8. The liquid ejecting apparatus as claimed in claim 6, wherein said first and second potential difference generating units are connected to said recording material side electrode.

9. The liquid ejecting apparatus as claimed in claim 1, wherein the polarities of said nozzle plate and said nozzle plate side electrode are the same as that of the liquid drops discharged by the liquid ejecting head and the polarity of said recording material side electrode is the same as that of satellite liquid generated when the liquid drops are discharged from the opening of the nozzle plate.

* * * * *